US006622741B2

(12) United States Patent
Lai

(10) Patent No.: US 6,622,741 B2
(45) Date of Patent: Sep. 23, 2003

(54) AUTOMATIC BENDING-ANGLE CHANGING STRUCTURE FOR UMBRELLA

(76) Inventor: Jin-Sheng Lai, 4F, No. 77, Sec. 4, Nang-Jing E. Rd., Taipei (TW)

( * ) Notice: Subject to any disclaimer, the term of this patent is extended or adjusted under 35 U.S.C. 154(b) by 50 days.

(21) Appl. No.: 09/953,561

(22) Filed: Sep. 17, 2001

(65) Prior Publication Data

US 2003/0051747 A1 Mar. 20, 2003

(51) Int. Cl.[7] ..... A45B 17/00

(52) U.S. Cl. ..... 135/20.3; 135/74; 248/514; 403/91

(58) Field of Search ..... 135/20.1, 20.3, 135/74, 909, 98; 242/395; 248/514; 403/91

(56) References Cited

U.S. PATENT DOCUMENTS 2,721,569 A * 10/1955 Militano ..... 135/20.3
3,311,119 A * 3/1967 Pearlstine ..... 135/20.3
4,582,078 A * 4/1986 Ma ..... 135/20.3
4,697,606 A * 10/1987 Ma ..... 135/20.3
4,878,509 A * 11/1989 Tung ..... 135/20.3
5,029,596 A * 7/1991 Tung ..... 135/20.3
6,311,705 B1 * 11/2001 Ma ..... 135/20.3
6,364,562 B1 * 4/2002 Tung ..... 403/93
6,446,650 B1 * 9/2002 Ma ..... 135/20.3

* cited by examiner

*Primary Examiner*—Carl D. Friedman
*Assistant Examiner*—Brian E. Glessner
(74) *Attorney, Agent, or Firm*—Dennison, Schultz & Dougherty

(57) ABSTRACT

An automatic bending-angle changing structure for an umbrella including an upper and a lower sleeve, a pulley holding rod, a pulley set, a turning cylinder, a turner bracket, a hinge set and a reel, wherein: the pulley set is pin connected with the pulley holding rod which then is extended into the upper sleeve, the turning cylinder is fitted in the upper sleeve; the lower end of the pulley holding rod is slipped thereover with the turning cylinder and is pin connected with the upper end of the hinge set, the lower end of the hinge set is pin connected with the turning cylinder and the turner bracket, thereby a linkage is formed; the lower end of the turner bracket is slipped into the lower sleeve having thereon the reel; a fine rope is wound on the pulley set by means of the reel to move the turning cylinder and the turner bracket, thereby the umbrella can have variation in opening, collapsing and bending. The structure can suit various big umbrellas; and the umbrella shafts can be changed in bending angles to shade sunshine.

7 Claims, 9 Drawing Sheets

AUTOMATIC BENDING-ANGLE CHANGING STRUCTURE FOR UMBRELLA

BACKGROUND OF THE INVENTION

1. Field of the Invention

The present invention is related to an automatic bending-angle changing structure for an umbrella, and especially to such a structure in which an upper and a lower sleeve are respectively fitted in a turning cylinder and a turner bracket to allow the two to turn relatively to each other and to allow the umbrella to open and collapse by means of a reel and a fine rope through controlling a runner, a pulley set and a hinge set. In this mode, the umbrella is convenient for manipulating in bending. Such structure suits big umbrellas or similar articles; the umbrellas can have bending angles of their shafts changed.

2. Description of the Prior Art

Since big umbrellas were widely used, sun-shading function of them has been highly thought of. In coincidence with the angles of sun shining to effectively shade direct incidence of sunshine, various big umbrellas are produced in large amount in the markets.

However, a positioning device for most conventional bending connectors of big umbrellas as shown in FIG. 1 is comprised mainly of: a bending body provided on the lower end thereof with two feet with bevel end faces which form therebetween a gap, a bevel stop surface is provided at the bottom of the gap; a round hole is provided on both the two feet. A connector for connecting stretchers is provided with a top protrusion also having a round holes thereon. An elastic spring loaded pin and a movable collar are provided at the junction of the bending body and the connector for connecting stretchers; by extending the spring loaded pin through the abovementioned round holes, and slipping of the movable collar over the junction, when in bending the umbrella, the bevel stop surface can maintain the bending angle and positioning. However, it only gets one bending angle, but can not coincide with the angles of sun shining; and by the fact that the weight of the umbrella is quite large, the umbrella must be manipulated with two hands and is subjected to the danger of tipping, thereby, the conventional structure is undesired.

Another conventional structure is shown in FIG. 2 which is comprised mainly of: an upper convex connector, a lower concave connector, a positioning rod, a spring cotter and a spring. The upper convex connector is provided on a flat upper engaging end portion thereof with a positioning flange; the lower concave connector is provided on the inner sides of the top engaging ribs thereof with arciform recesses for engaging and limiting to prevent overly large bending angles, and the bending angles can be predetermined. Thereby, practicality of convenient engaging and positioning in bending can be obtained. However, such a positioning device for bending connectors of big umbrellas can only render the lower concave connectors provided on the inner sides of the top engaging ribs thereof with arciform recesses for engaging and limiting, direction variations are few, and each time when it is bent, the positioning rod must be pulled out and the upper convex connector has to be supported with one hand; and by the fact that the weight of the umbrella supported by the upper convex connector is quite large, the umbrella must be manipulated with two hands, an operator thereby is subjected to uneasy holding and damaging his hands. The conventional structure is uneasy for manipulation and can not completely shade direct incidence of sunshine as well as is subjected to damaging hands of an operator; it is still undesired.

In view of the above statement, the inventor desired to avoid the abovementioned defects resided in conventional structures, and expected to provide a structure which is able to shade direct sunshine irrespective of the angle of incidence of sunshine, and is convenient and power saving for manipulation; after hard study and tests, the present invention is provided.

SUMMARY OF THE INVENTION

The main object of the present invention is to provide an automatic bending angle changing structure for an umbrella, the structure on the shaft of the umbrella is apparently identical to a normal shaft of the umbrella, while the shaft is bendable and suits various umbrellas.

The secondary object of the present invention is to provide an automatic bending angle changing structure for an umbrella, by which a user needs only to rotate a reel with one hand to open the folded umbrella easily, and the shaft of the umbrella can be bent for various bending angles, these are convenient for manipulation, and thereby convenience of use of umbrellas can be increased.

To get the above stated objects, the present invention is comprised of an upper and a lower sleeve, a pulley holding rod, a turning cylinder, a turner bracket, a pulley set and a hinge set. The pulley set is mounted on the pulley holding rod which then is extended into the upper sleeve, and the turning cylinder is slipped over the upper sleeve; the lower end of the pulley holding rod is slipped thereover with the turning cylinder and is pin connected with the upper end of the hinge set, the lower end of the hinge set is pin connected with the turning cylinder and the turner bracket; thereby a linkage is formed. The lower end of the turner bracket is slipped into the lower sleeve which is provided thereon with the reel; a fine rope is wound on the pulley set by means of the reel to move the runner, the turning cylinder and the turner bracket, thereby the umbrella can have variation in opening, collapsing and bending. Thereby the structure is convenient and power saving for manipulation, and can have bending angles of the shaft of the umbrella changed to shade sunshine, and thereby practicality and convenience of the umbrella is increased.

The present invention will be apparent in its structure and features after reading the detailed description of the preferred embodiment thereof in reference to the accompanying drawings.

DETAILED DESCRIPTION OF THE PREFERRED EMBODIMENT

Figure 1:
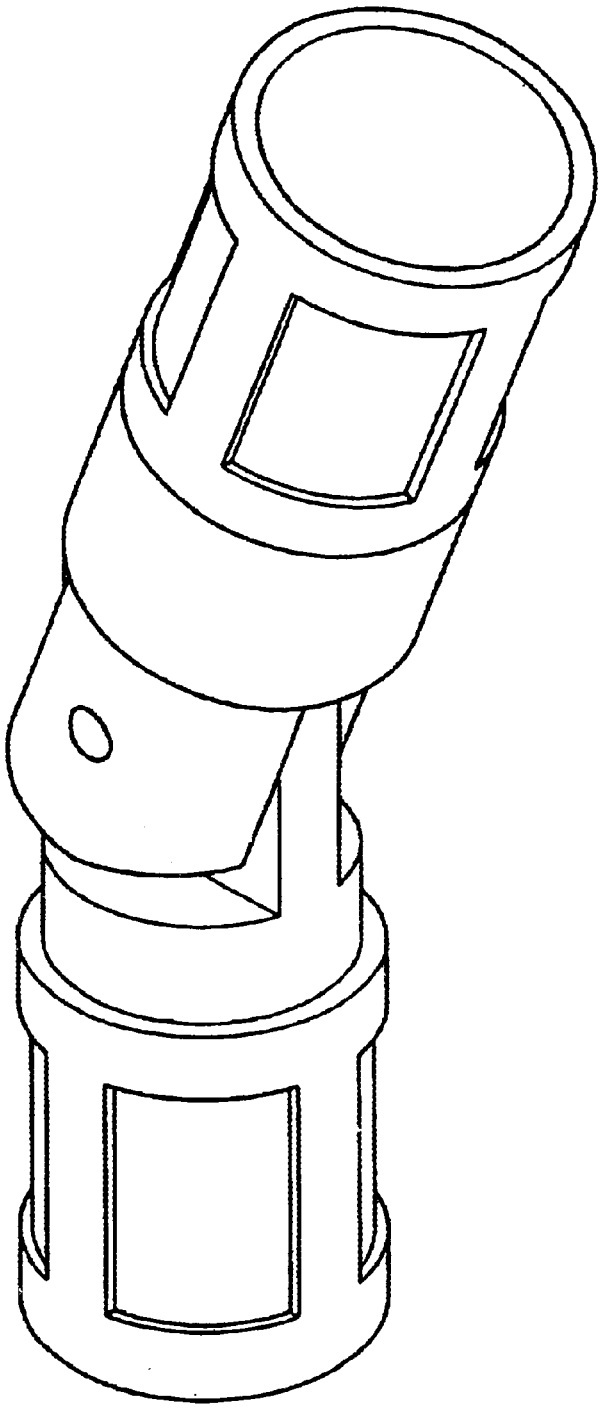
Fig. 1(Prior Art)
FIG. 1 is a perspective view of a conventional structure.
Figure 2:
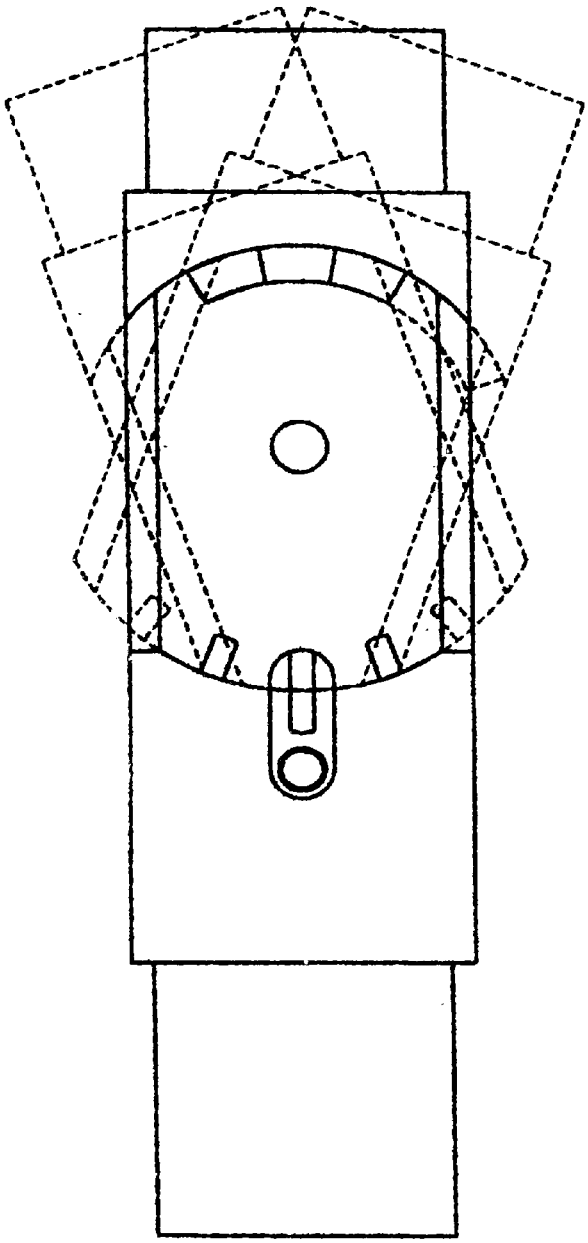
Fig. 2(Prior Art)
FIG. 2 is a perspective view of another conventional structure.
Figure 3:
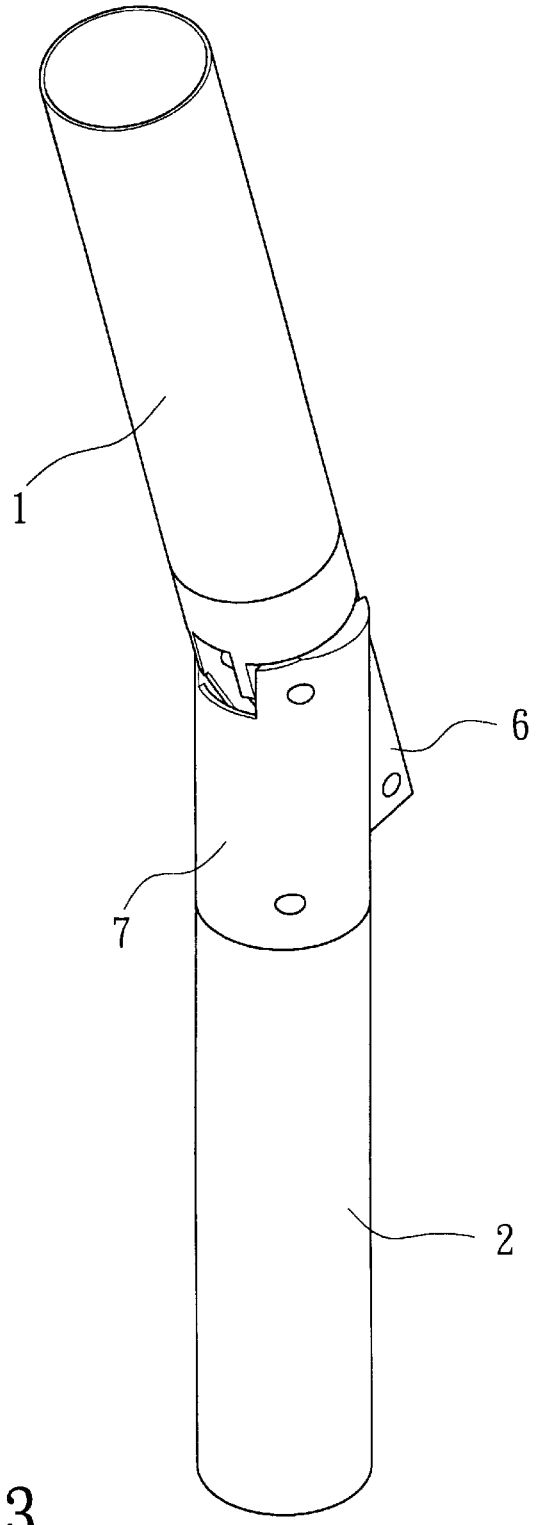
FIG. 3 is a perspective view of an embodiment of the present invention.
Figure 4A:
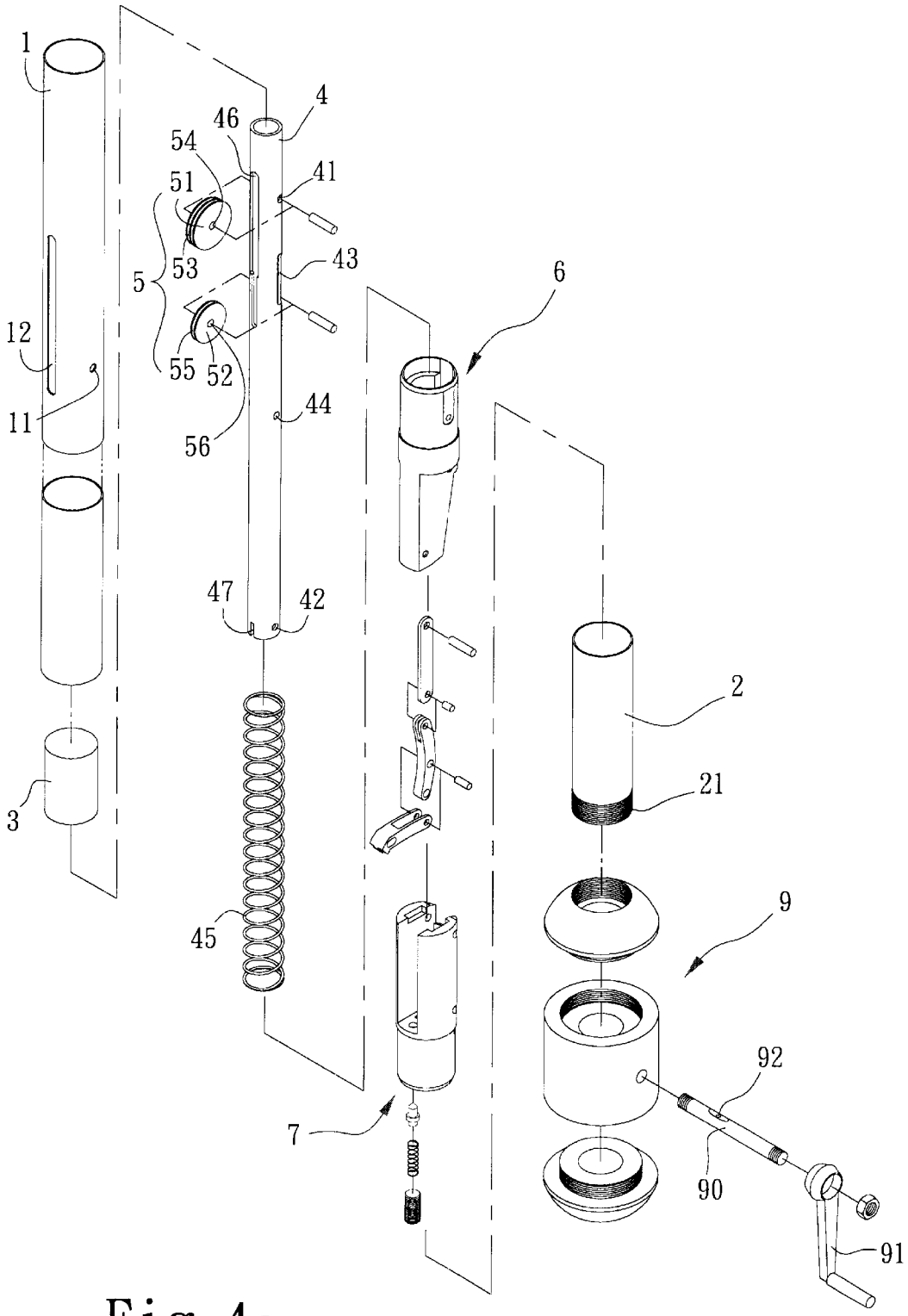
FIG. 4*a* is an analytic perspective view of the embodiment of the present invention.
Figure 4B:
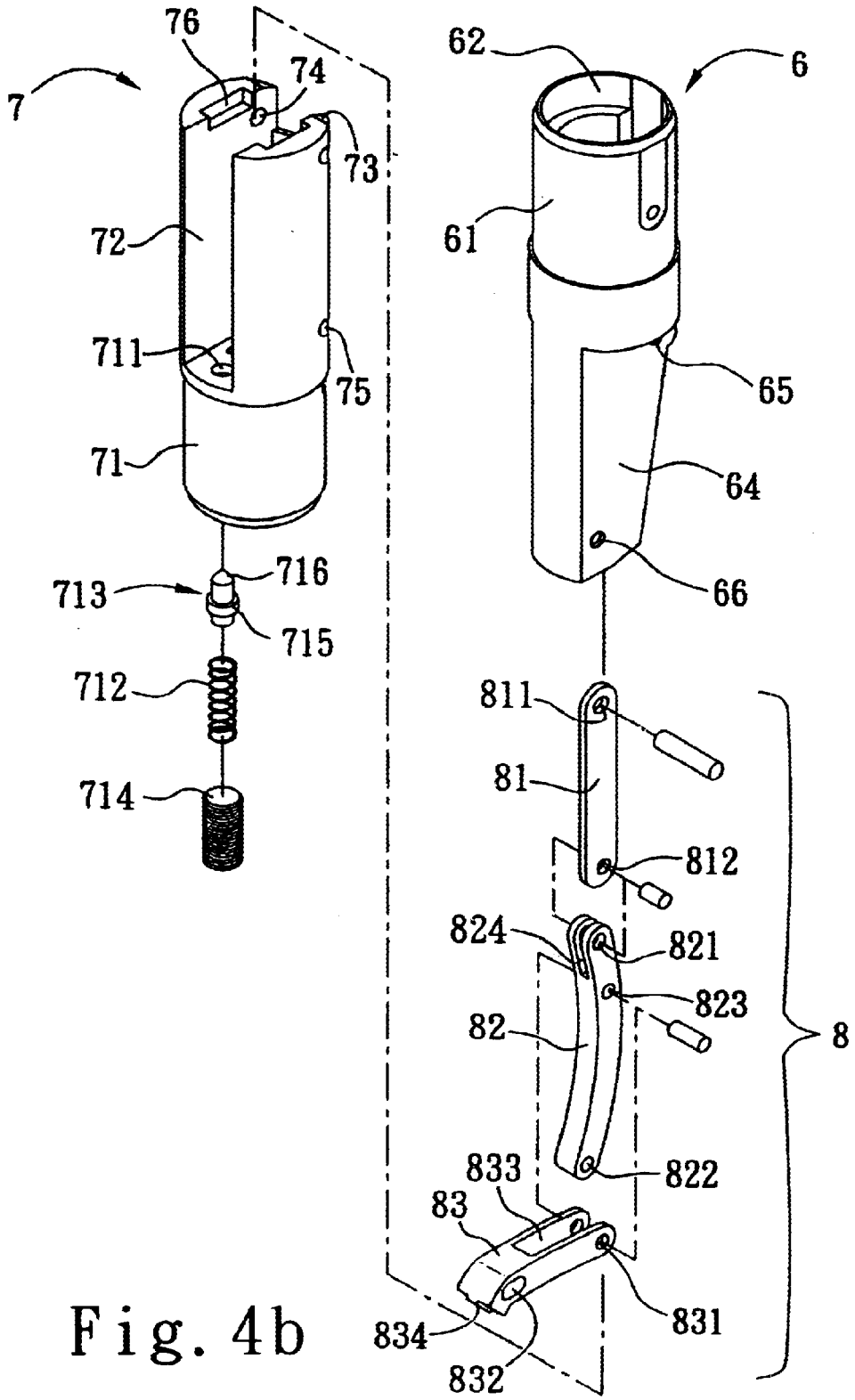
FIG. 4*b* is an analytic perspective view showing the bending portion of the embodiment of the present invention.

Referring to FIGS. 4*a* and 4*b*, the automatic bending angle changing structure for an umbrella of the present invention is comprised of the elements including an upper sleeve 1, a lower sleeve 2, a guiding block 3, a pulley holding rod 4, a pulley set 5, a turning cylinder 6, a turner bracket 7, a hinge set 8 and a reel 9 etc. Wherein:

The upper sleeve 1 is a hollow sleeve, it is provided on an appropriate location thereon with an elongate slit 12 and on one side thereof with a hole 11; the upper sleeve 1 is further provided on the external surface thereof with a stop collar 14 for stopping a runner 13. The runner 13 is a cylindrical collar connected thereon with stretchers, and is slipped over the upper sleeve 1 in order to open the stretchers and the umbrella.

The lower sleeve 2 is also a hollow sleeve, it is provided on an appropriate location thereon with a thread 21 for mounting thereon the reel 9.

The guiding block 3 is a cylindrical block with a diameter exactly slightly smaller than that of the upper sleeve 1, and is provided on the bottom thereof with a groove for mounting the pulley holding rod 4.

And the pulley holding rod 4 is a cylindrical rod with a hole 41 and a hole 42 on the upper and the lower ends thereof respectively. The pulley holding rod 4 is provided in the middle section thereof with a slide slot 43, a hole 44 is located a distance suitably down from the slide slot 43 and is provided therein with a spring 45. The pulley holding rod 4 is provided on one side thereof with an elongate embedding slot 46 for embedment therein the pulley set 5, and is provided on the lower end thereof with a notch 47 for mounting therein a hinge 81.

The pulley set 5 is comprised of a twin grooved pulley 51 and a single grooved pulley 52. The twin grooved pulley 51 is a round disk with two grooves 53, and is provided with a central hole 54; the single grooved pulley 52 is a round disk with a groove 55, and is also provided with a central hole 56. The twin grooved pulley 51 and the single grooved pulley 52 use a fine rope suitably extended and wound to form the power saving pulley set 5.

The turning cylinder 6 is provided thereon with a cylindrical fixing seat 61 which slips over the upper sleeve 1 and is provided therein with a recess 62 and a central through hole 63; they are used to stop a spring 45 and for extending therein the pulley holding rod 4 respectively. The lower end of the turning cylinder 6 is provided thereon with a pivotally connecting portion 64 being an elongate hollow bar with its both sides tapered and provided thereon with two holes 65, 66 at suitable locations respectively for pivotally connecting the turner bracket 7 and the hinge set 8. A stepped stopping block 67 is provided on both sides at the top end of the pivotally connecting portion 64 in favor of bending and positioning of it, while the bottom end of the pivotally connecting portion 64 is provided with an engaging hole 68 to engage with a tenon 713.

The turner bracket 7 has on the lower end thereof a fixing seat 71 to slip over the lower sleeve 2, the fixing seat 71 is provided therein with a tenon seat 711 having therein a spring 712, the tenon 713 and a fixing plug 714. The tenon 713 is a cylinder for extending into the tenon seat 711 and is provided with a protruding conical upper end 716 and a flange 715 suitably in the middle thereof to stop the spring 712 to prevent the tenon 713 from dropping out of the tenon seat 711. The turner bracket 7 is provided on the upper end thereof with a pivotally connecting longitudinal recess 72 on which the bifurcated upper ends are provided with a plurality of bevel surfaces 73 and grooves 76 for stopping the stepped stopping block 67 thereon to control the terminal bending position desired of the turning cylinder 6. The pivotally connecting longitudinal recess 72 is provided on the two lateral sides thereof with two holes 74, 75 for pivotally connecting the turning cylinder 6 and the hinge set 8.

The hinge set 8 is comprised of an upper link 81, a longer link 82 and a shorter link 83, the upper link 81 is elongate and flat and is provided on the two ends thereof with a hole 811 and a hole 812 respectively, one of the two ends is pivotally connected to the pulley holding rod 4, while the other end is pivotally connected to the longer link 82. The longer link 82 is an arciform elongate sheet, and is provided on the two ends thereof with a hole 821 and a hole 822 for pivotally connecting with the upper link 81 and the turner bracket 7. The longer link 82 is also provided in the middle thereof with a hole 823 for pivotally connecting with the shorter link 83. The longer link 82 is further provided on the top thereof with a slit 824 for extending therein the upper link 81. The shorter link 83 is an arciform bar with two holes 831, 832 on the two ends thereof for pivotally connecting with the longer link 82 and the turning cylinder 6, one end of the shorter link 83 connecting with the turning cylinder 6 has two stopping surfaces 834 to engage the tenon 713 and the turning cylinder 6 for preventing the umbrella from shaking after bending, a slit 833 is provided on the other end of the shorter link 83 for extending therein the longer link 82.

The reel 9 includes a cylindrical main body 90 having thereon a rotating handle 91 and a middle through hole 92, rotation of the rotating handle 91 can render the cylindrical main body 90 with the middle through hole 92 to rotate and to wind the fine rope around the cylindrical main body 90, the fine rope can be contracted or extended thereby.

Figure 5A:
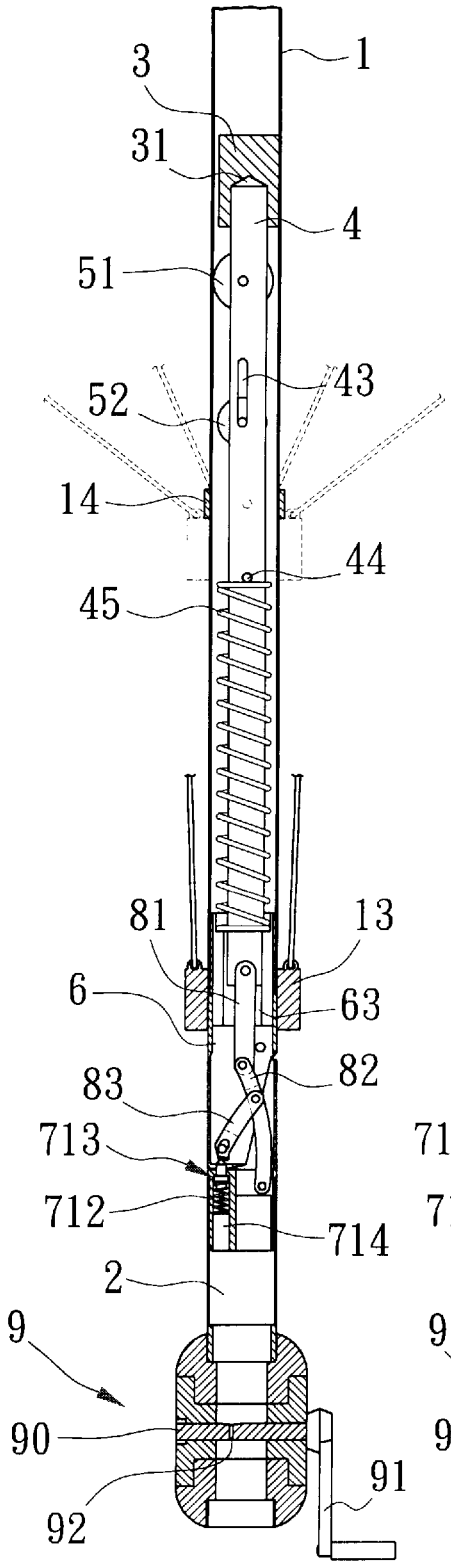
FIG. 5*a* is a sectional view showing the embodiment of the present invention before bending.
Figure 6:
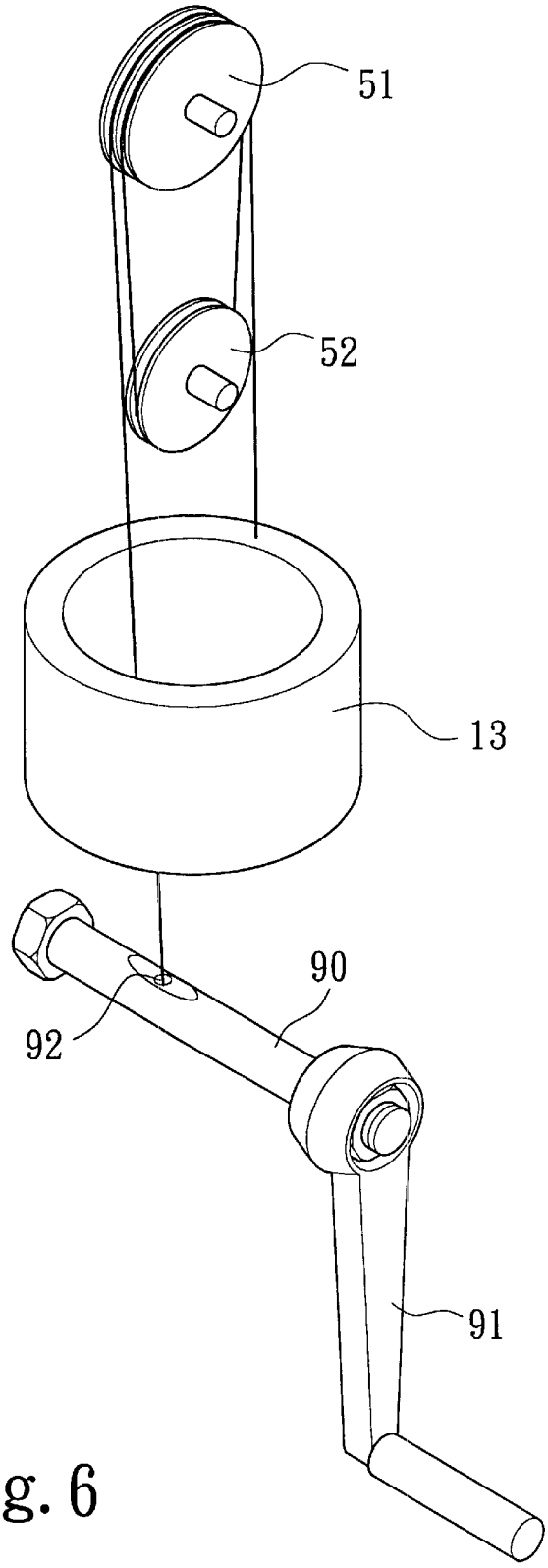
FIG. 6 is schematic view showing a fine rope is wound onto a pulley set in the present invention.

Referring to FIGS. 4*a* and 5*a*, when in assembling the present invention, the guiding block 3 is slipped over the upper end of the pulley holding rod 4, and the spring 45 is also slipped over the pulley holding rod 4 and is fixed in the hole 44. The pulley holding rod 4 then is slipped in the upper sleeve 1, and the twin grooved pulley 51 is placed into the upper end of the elongate embedding slot 46 via the elongate slit 12 to connect by means of a pin with the hole 41 of the pulley holding rod 4; then the single grooved pulley 52 is placed into the lower end of the elongate embedding slot 46, the axis of the single grooved pulley 52 is aligned with and is connected by means of a pin with the hole 11 on the upper sleeve 1 through the slide slot 43. The hole 42 on the lower end of the pulley holding rod 4 is pivotally connected with the hole 811 on the upper link 81. Referring to FIG. 4*b*, the cylindrical fixing seat 61 of the turning cylinder 6 is slipped in the upper sleeve 1, and the pulley holding rod 4 is extended into the central through hole 63, the hole 65 of the turning cylinder 6 is pivotally connected with the hole 74 on the turner bracket 7, the hole 66 is pivotally connected with the hole 832 on the shorter link 83; the hinge set 8 has the upper link 81 pivotally connected with the hole 821 on the longer link 82 via the hole 812 of the upper link 81, and has the shorter link 83 pivotally connected with the hole 823 on the longer link 82 via the hole 831 of the shorter link 83, thus a linkage is completed. The holes 811, 822 and 832 are pin connected with the holes 42, 75 and 66. The hole 74 on the cylindrical fixing seat 61 is pin connected with the hole 65 of the turning cylinder 6; while the hole 75 is pin connected with the hole 822 of the longer link 82; the tenon seat 711 in the fixing seat 71 thereunder is provided therein with the tenon 713, the spring 712 and the fixing plug 714; the protruding conical upper end 716 of the tenon 713 is exposed to the outside of the tenon seat 711, and the fixing seat 71 is fitted in the lower sleeve 2. Referring to FIG. 6, the reel 9 is slipped over the lower sleeve 2, and is connected with the pulley set 5 through the winding fine rope, one end of the fine rope is fixed to the middle through hole 92, and the other end is fixed to the runner 13. Thereby, when the handle 91 is rotated, the fine rope is wound around the cylindrical main body 90.

Figure 5B:
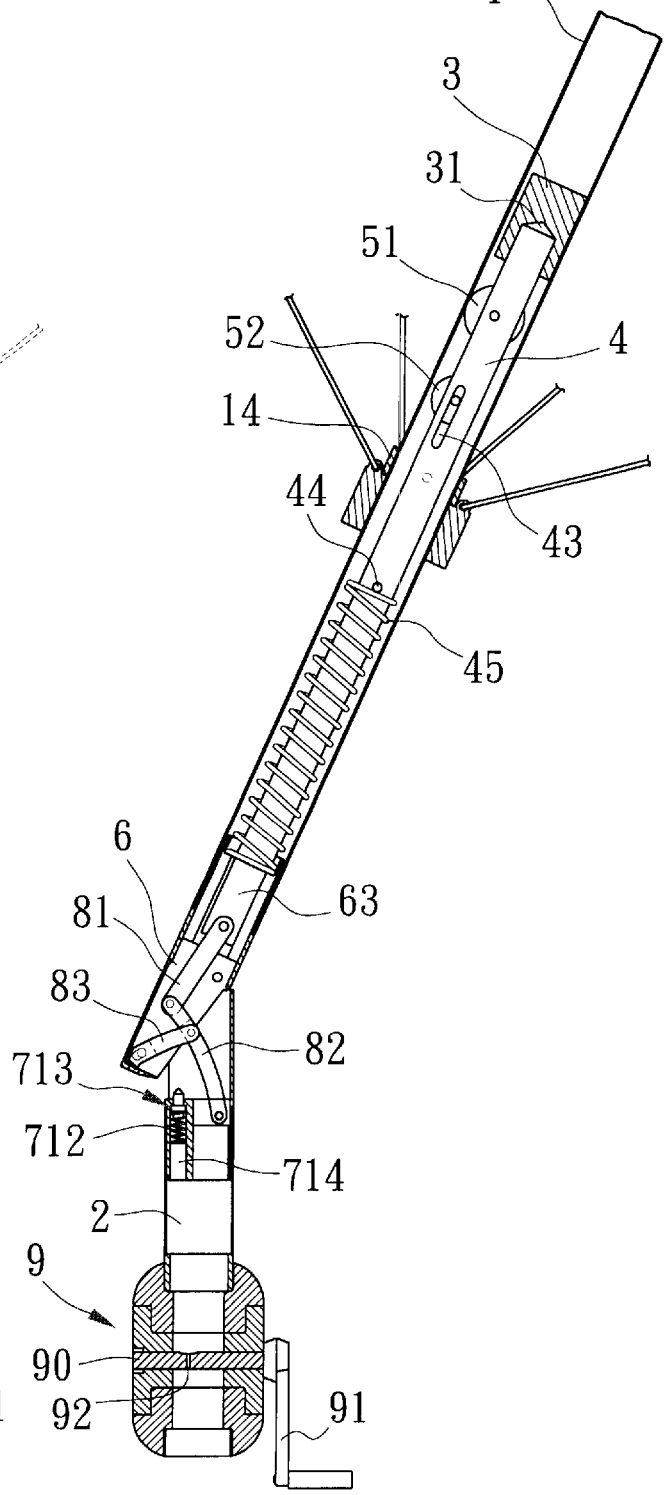
FIG. 5*b* is a sectional view showing the embodiment of the present invention after bending.
Figure 5C:
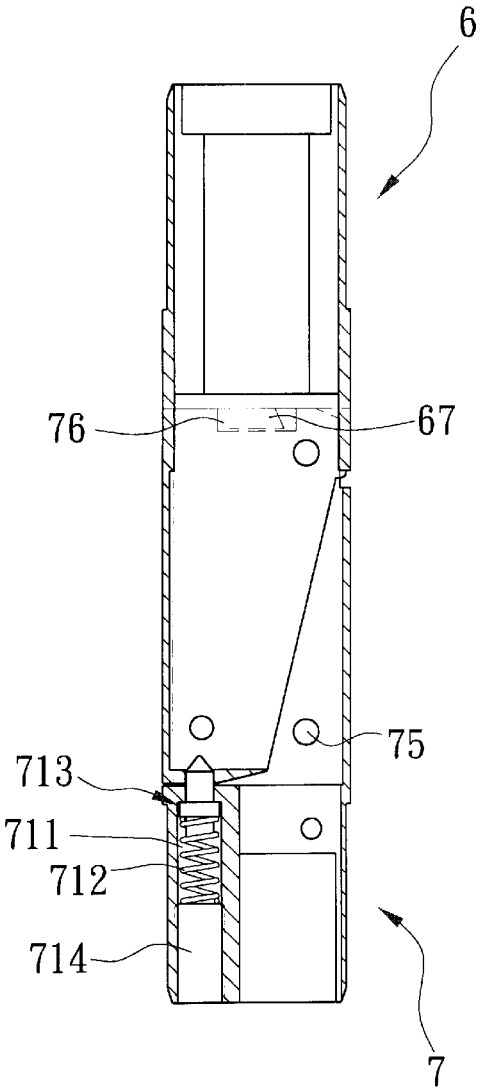
FIG. 5*c* is a sectional view showing a turning cylinder and a turner bracket of the embodiment of the present invention before bending.
Figure 5D:
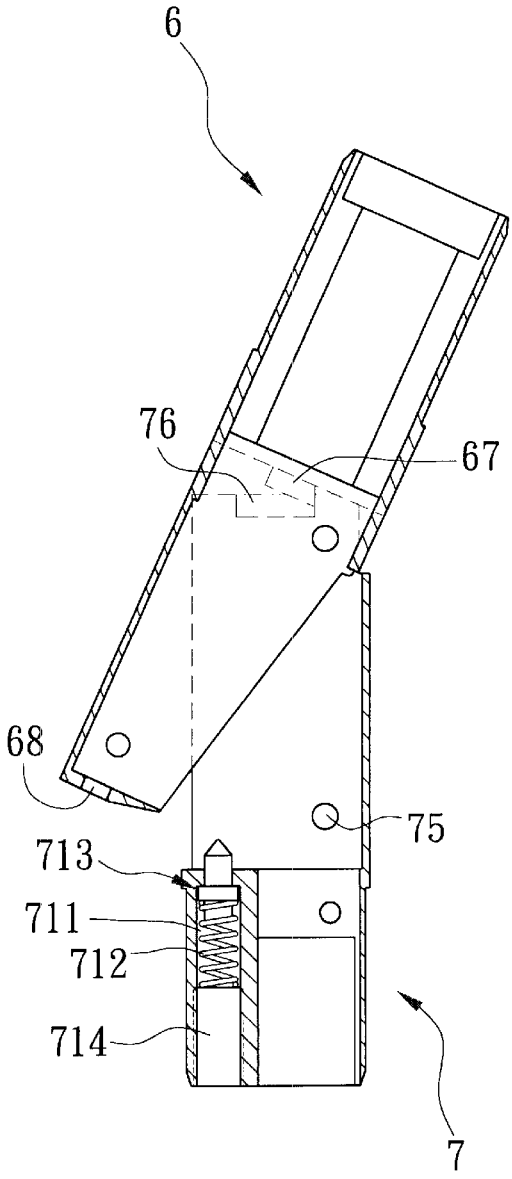
FIG. 5*d* is a sectional view showing a turning cylinder and a turner bracket of the embodiment of the present invention after bending.
Figure 7:
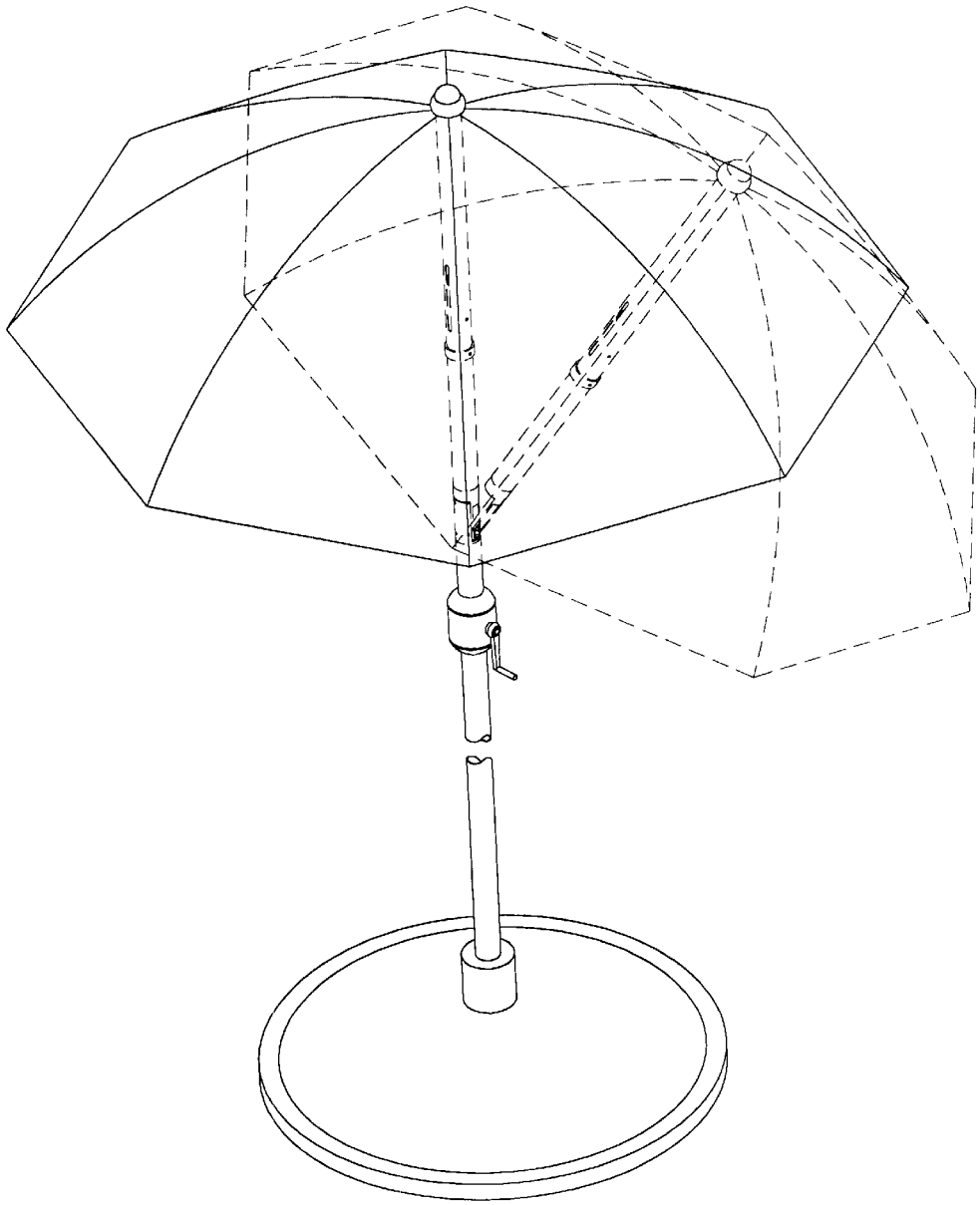
FIG. 7 is a schematic view showing the appearance of the embodiment of the present invention in use.

With the above stated members forming the automatic bending-angle changing structure for an umbrella, referring to FIG. 7, the present invention is characterized by that: the bending mechanism combined from the upper sleeve 1 and the lower sleeve 2 can allow the umbrella to have multiple bending angles. Referring to FIG. 5*a*, by providing the reel 9 on the lower sleeve 2, when the handle 91 is rotated, the fine rope is wound around the cylindrical main body 90 to shorten the released length of the fine rope and to raise the runner 13, thereby, the umbrella can be opened. When the runner 13 is raised to abut against the stop collar 14, and if rotation of the handle 91 is stopped, the umbrella is in the open state. Referring to FIG. 5*b*, if rotation of the handle 91 continues, the pulleys 51 and 52 are forced to get close to each other to thereby move the pulley holding rod 4 down, and in turn to press hinge set 8 of which the shorter link 83 is moved leftwards to press the tenon 713 down and to release it from the turner bracket 7, so that the turner bracket 7 moves sidewards to allow the turning cylinder 6 to move sidewards too, thus the umbrella shaft can be bent. Referring to FIGS. 5*c* and 5*d*, when the turning cylinder 6 is bent to the terminal position, the top end of the pivotally connecting portion 64 of the turning cylinder 6 abuts on the bevel surfaces 73 on the top end of the pivotally connecting longitudinal recess 72 of the turner bracket 7, while the protruding stepped stopping block 67 is embedded in the grooves 76 provided on the pivotally connecting longitudinal recess 72. And the two stopping surfaces 834 of the shorter link 83 are abutted on the turning cylinder 6. With the above stated structure, the umbrella can be opened and fixed easily without shaking, when the reel 9 releases the fine rope, the spring 45 gives the pulley holding rod 4 an upward action force to restore the turning cylinder 6 to its original position, so that the tenon 713 extends into the engaging hole 68 on the bottom of the pivotally connecting portion 64 of the turning cylinder 6. Thereby, the turning cylinder 6 is fixed on the turner bracket 7 to fix the umbrella without being subjected to shaking. If releasing of the fine rope is continued, by the action of gravity, the runner 13 is lowered to collapse the umbrella. With the above stated structure, the umbrella of the present invention can be opened and collapsed easily, and can be firmly combined and easily bent in multiple bending angles, thus practicality as well as safety of the present invention can be increased.

Therefore, the present invention has the following advantages:

1. The present invention has a pulley set therein, thereby, an effect of power saving for bending the umbrella shaft can be achieved.
2. The present invention needs only to rotate a rotary handle to open and bend the umbrella, thereby, an effect of convenience in manipulation can be provided, and convenience of using can be increased.
3. The present invention is provided with a reel, a pulley set and a hinge set, bending of the umbrella shaft can be varied within a given scope of angle; hence practicability of it can be increased.

In conclusion, the present invention can not only get rid of the defects resided in the bending structure of a conventional umbrella, but also can get the effects of convenience of operation, power saving and bending in multiple angles, practicality and convenience of use of the present invention can be largely increased, and the present invention can suit various big umbrellas.

Having thus described my invention, what I claim as new and desire to be secured by Letters Patent of the United States are:

1. An automatic bending-angle changing structure for an umbrella comprising:

an upper sleeve, a lower sleeve, a pulley holding rod, a pulley set, a turning cylinder, a turner bracket, a hinge set and a reel, wherein said structure is characterized by:

said pulley set is pin connected with said pulley holding rod and said upper sleeve, said pulley holding rod is extended in said upper sleeve, said turning cylinder is fitted in said upper sleeve, the lower end of said pulley holding rod is slipped over said turning cylinder and is pin connected thereto and with the upper end of said hinge set pin connected with said turning cylinder and with the lower end of said hinge set pin connected with said turner bracket thereby a linkage is formed:

the lower end of said turner bracket fitting into said lower sleeve which is provided thereon with said reel;

a fine rope is wound on said pulley set by means of said reel to move said turning cylinder and said turner bracket, thereby said umbrella can have variation in bending and wherein:

a guiding block is provided on the upper end of said pulley holding rod to avoid deviation and jam of said pulley holding rod.

2. An automatic bending-angle changing structure for an umbrella as in claim 1, wherein:

said hinge set is comprised of a plurality of links, said links are elongate or arciform flat sheets.

3. An automatic bending-angle changing structure for an umbrella as in claim 1, wherein:

said links are provided thereon with a plurality of holes and slits for mutual pin connection or for pin connection with other members.

4. An automatic bending-angle changing structure for an umbrella as in claim 1, wherein:

one of said links is provided on one end thereof with stopping surfaces to stop and position said turning cylinder.

5. An automatic bending-angle changing structure for an umbrella as in claim 1, wherein:

said turning cylinder is provided thereon with a cylindrical fixing seat to slip into said upper sleeve, and is provided on the lower end thereof with a pivotally connecting portion being an elongate hollow bar with both sides tapered and provided thereon with a plurality of holes respectively for pivotally connecting said turner bracket and said hinge set and wherein:

a stepped stopping block is provided on both sides at the top end of said pivotally connecting portion to be stopped on said turner bracket to fix said umbrella without being subjected to shaking when in bending, while the bottom end of said pivotally connecting portion is provided with an engaging hole for extending therein of a tenon to firmly engage with said turner bracket.

6. An automatic bending-angle changing structure for an umbrella as in claim 1, wherein:

said turner bracket has on the lower end thereof a fixing seat to slip over said lower sleeve, said turner bracket is provided on the upper end thereof with a pivotally connecting longitudinal recess on lateral sides of which a plurality of holes are provided for pivotally connecting said turner cylinder and said hinge seat; and wherein said fixing seat is provided therein with a tenon seat having therein a spring, a tenon and a fixing plug, for stopping two stopping surfaces of a link in order that said umbrella does not shake.

7. An automatic bending-angle changing structure for an umbrella as in claim 6, wherein:

said tenon extends into said tenon seat and is provided with a protruding conical upper end and a flange in the middle thereof to stop said spring and to prevent said tenon from dropping out of said tenon seat.

* * * * *